US012060088B2

(12) United States Patent
Pfeifer et al.

(10) Patent No.: US 12,060,088 B2
(45) Date of Patent: Aug. 13, 2024

(54) METHOD FOR DETECTING WEAR OF A CABLE ROLLER OF A CABLEWAY INSTALLATION

(71) Applicant: Innova Patent GmbH, Wolfurt (AT)

(72) Inventors: Daniel Pfeifer, Sankt Anton am Arlberg (AT); Adrian Mohni, St. Gallen (CH)

(73) Assignee: Innova Patent GmbH (AT)

( * ) Notice: Subject to any disclaimer, the term of this patent is extended or adjusted under 35 U.S.C. 154(b) by 280 days.

(21) Appl. No.: 17/595,815

(22) PCT Filed: May 18, 2020

(86) PCT No.: PCT/EP2020/063812
§ 371 (c)(1),
(2) Date: Nov. 24, 2021

(87) PCT Pub. No.: WO2020/239497
PCT Pub. Date: Dec. 30, 2020

(65) Prior Publication Data

US 2022/0219739 A1 Jul. 14, 2022

(30) Foreign Application Priority Data

May 28, 2019 (AT) ..... A50487/2019

(51) Int. Cl.
*B61B 12/06* (2006.01)
*B61B 12/02* (2006.01)

(52) U.S. Cl.
CPC ..... *B61B 12/06* (2013.01); *B61B 12/022* (2013.01); *B61B 12/026* (2013.01)

(58) Field of Classification Search
CPC ..... B61B 12/06; B61B 12/022; B61B 12/026; B61B 12/02; G01B 7/023
See application file for complete search history.

(56) References Cited

U.S. PATENT DOCUMENTS 5,581,180 A * 12/1996 Ito ..... B61B 12/02 324/207.2
5,731,528 A * 3/1998 Yamazaki ..... G01L 5/042 73/862.41
2003/0011483 A1* 1/2003 Lamb ..... B66B 7/1223 187/390
2005/0099176 A1* 5/2005 Heimlicher ..... H03K 17/95 324/207.26

(Continued)

FOREIGN PATENT DOCUMENTS

CN 1154172 A 7/1997
CN 1280719 A 1/2001

(Continued)

OTHER PUBLICATIONS

Office Action dated Mar. 31, 2023 for Chinese Patent Application No. 202080039300.4.

(Continued)

*Primary Examiner* — Akm Zakaria

(57) ABSTRACT

For reliable detection of the wear on a cable sheave of a cable car system, the distance between a cable sensor and a hoisting cable is measured when the cable car system is at a standstill and the wear on the at least one cable sheave is deduced from the distance measured at a standstill.

9 Claims, 3 Drawing Sheets

(56) References Cited

U.S. PATENT DOCUMENTS

| | | | | |
|---|---|---|---|---|
| 2011/0073000 | A1* | 3/2011 | Thum | B61B 12/06 104/112 |
| 2015/0063415 | A1* | 3/2015 | Garfinkel | G01N 27/20 324/693 |
| 2022/0120711 | A1* | 4/2022 | Wickert | E01D 19/16 |

FOREIGN PATENT DOCUMENTS

| | | | |
|---|---|---|---|
| CN | 1397797 | A | 2/2003 |
| CN | 1614890 | A | 5/2005 |
| CN | 107131208 | A | 9/2017 |
| DE | 19752362 | A1 | 6/1999 |
| DE | 10320093 | A1 | 11/2004 |
| DE | 102008015035 | A1 | 9/2009 |
| DE | 102017217830 | A1 | 4/2019 |
| EP | 3620340 | A1 | 3/2020 |
| WO | 2010076644 | A1 | 7/2010 |
| WO | 2019038397 | A1 | 2/2019 |

OTHER PUBLICATIONS

International Search Report and Written Opinion of the International Searching Authority; Application No. PCT/EP2020/063812; Completed: Aug. 3, 2020; Mailing Date: Aug. 21, 2020; 8 Pages.

* cited by examiner

METHOD FOR DETECTING WEAR OF A CABLE ROLLER OF A CABLEWAY INSTALLATION

TECHNICAL FIELD

The present teaching relates to a method for detecting wear on a cable sheave of a cable car system having a hoisting cable, which is guided over the at least one cable sheave, and having at least one cable sensor which is arranged in a known position with respect to the cable sheave and by means of which the distance between the hoisting cable and the cable sensor is detected.

BACKGROUND

In cable car systems, a hoisting cable of the cable car is guided over cable sheaves on the route and in the stations. The hoisting cable is guided on the cable sheave on a running surface, usually on a rubber ring having a cable guide groove. The cable sheave, in particular a rubber ring of the cable sheave, can wear out during operation of the cable car, for example due to vehicles commuting on the hoisting cable or due to asymmetrical loading of the vehicles, but also during normal operation due to the pressure of the hoisting cable on the running surface of the cable sheave. However, the hoisting cable can also stray on the cable sheave (lateral deviation of the hoisting cable from the cable guide groove of the cable sheave), which in the worst case can lead to the hoisting cable jumping out of a cable sheave. It is therefore already known to provide cable position monitoring during operation in cable car systems in the region of the sheave sets on the cable car supports or in a station in order to detect inadmissible straying, i.e., a lateral deviation, of the hoisting cable on a cable sheave. The cable position is monitored by means of contactless sensors, for example inductive proximity sensors (e.g., as in DE 197 52 362 A1), Hall sensors (e.g., as in U.S. Pat. No. 5,581,180 A) or eddy current sensors (e.g., as in WO 2019/038397 A1). In the event of an impermissible lateral deviation of the hoisting cable, the cable car system is stopped, or the conveying speed is reduced. Both are of course undesirable in the operation of the cable car system.

The wear on the running surface of the sheave, for example on the rubber ring, is usually monitored during operation in order to be able to replace cable sheaves with excessive wear in good time in order to prevent operational restrictions or operational interruptions. This can either be carried out by maintenance personnel by visual inspection at certain inspection intervals, or it can be automated. For example, it is known from DE 197 52 362 A1 to use a contactless sensor to detect not only the cable position but also wear on the running surface of a cable sheave during operation. U.S. Pat. No. 5,581,180 A and WO 2019/038397 A1 also describe that the cable position sensors can also be used to detect wear on the cable sheave. In order to detect wear, the distance between a stationarily mounted cable position sensor and the hoisting cable is determined when the cable car is in operation.

However, the operating conditions of a cable car system are very harsh. During operation, ambient temperature fluctuations of several 10° C. are possible over a day, which can lead to thermal expansion (in the sense of becoming smaller or larger) of the cable sheave. The distance between the hoisting cable and a cable position sensor can change noticeably, which has a negative impact on the reliability of the distance measurement. Due to the friction between the hoisting cable and the cable sheave or the running surface of the cable sheave, cable sheaves can heat up during operation in relation to the environment and in particular also in relation to the sensor, which can also lead to a change in the detected distance between the hoisting cable and the cable position sensor. Because of that, the detected distance can change by a few millimeters during operation. The hoisting cable itself is subject to vibrations during operation, for example due to the cable sheaves being driven over by the cable clamps of the vehicles or due to external influences on the cable car system such as wind, which means that the detected distance between the cable position sensor and the hoisting cable can also change continuously during operation. All of this makes it unreliable and difficult for a contactless sensor to detect the wear on a cable sheave by means of distance measurement during operation.

SUMMARY

It is therefore an object of the present teaching to improve detection of the wear on a cable sheave of a cable car system, in particular to make it more reliable, and thus to improve the operation, especially the maintenance, of a cable car system.

This object is achieved in that the distance is measured when the cable car system is at a standstill and the wear on the at least one cable sheave is deduced from the distance measured at a standstill. By detecting the wear on a cable sheave when the cable car system is at a standstill, the influences on the distance measurement caused by operation can be reduced or even eliminated in a simple manner. In particular, it has been recognized that the distance does not have to be detected during operation because the wear resulting from the distance changes only slowly anyway. It is therefore advantageous if the distance is detected at a standstill, since this also gives more precise results. This also makes it possible, in a particularly advantageous embodiment, to use an existing cable position sensor as a cable sensor for distance detection. This means that no additional hardware is required. This also makes it possible to replace the cable sheave of the cable car system in good time if the wear exceeds a specified permissible limit value.

In order to increase the accuracy of the detection of the wear, it can be provided that the temperature of the cable sheave is detected and the thermal expansion of the cable sheave at the detected temperature is taken into account when the distance is detected. Any temperature-related thermal expansion of the cable sheave can thus be taken into account or compensated for. The detection of the distance, and thus also of the wear, can also be related to a specific reference temperature.

In an advantageous embodiment, the distance is measured on several days, preferably on every day or every xth day where $x>1$ or at a predetermined time interval, in particular always at the same point in time in a full day. This also makes it possible to detect a progression of the wear over time. Further knowledge about the cable car system can be obtained from the progression over time. For example, if a cable sheave wears too quickly over a certain period of time, another problem with the cable car system could be deduced.

BRIEF DESCRIPTION OF THE DRAWINGS

The present teaching is described in greater detail below with reference to FIGS. 1 to 5, which show schematic and non-limiting advantageous embodiments of the present teaching by way of example, and in which.

DETAILED DESCRIPTION

Figure 1:
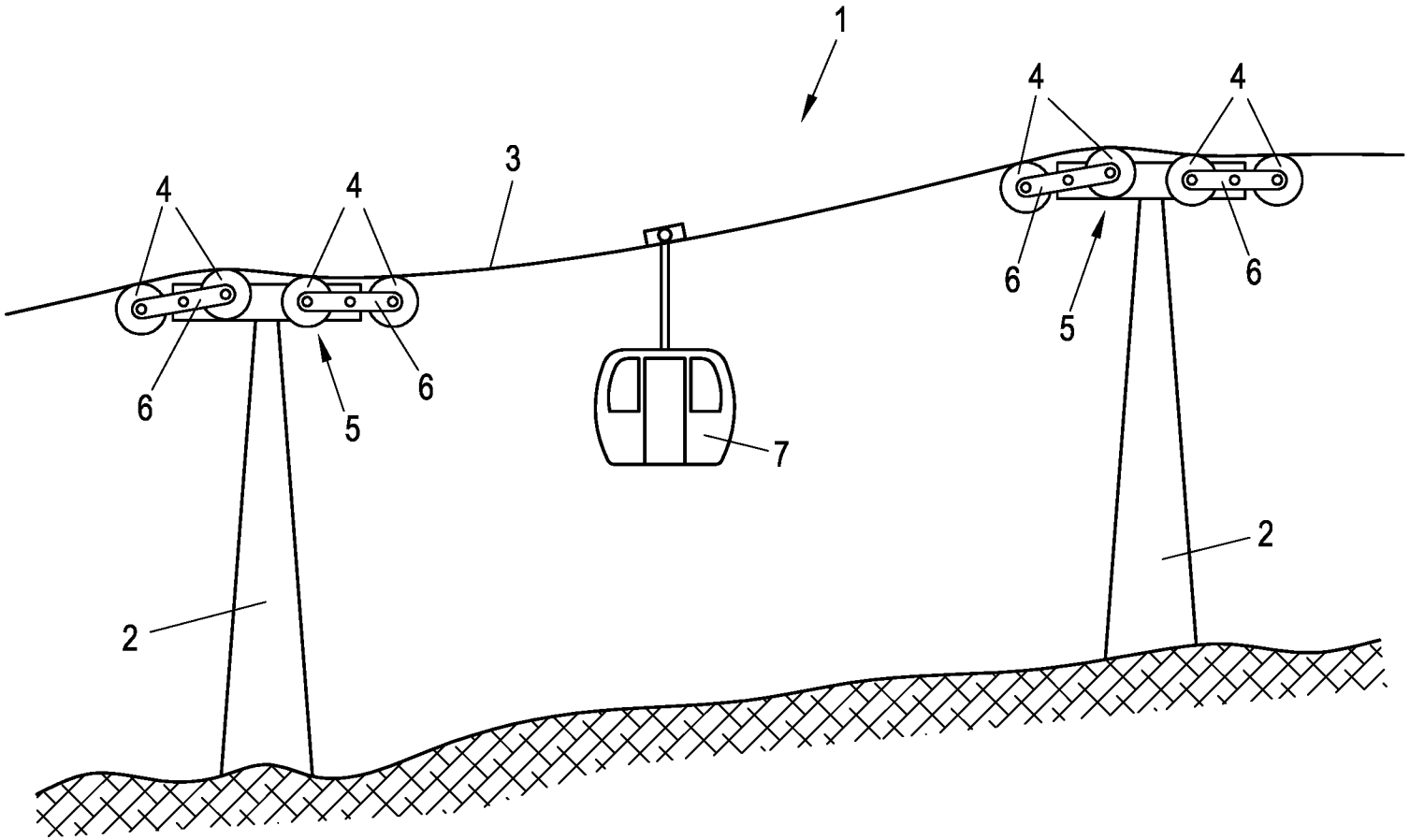
FIG. 1 shows part of a cable car system.

In FIG. 1, part of a well-known cable car system 1 with two cable car supports 2 is shown. At least one hoisting cable 3 is guided between two cable car stations (not shown) via cable sheaves 4, in either a rotating or pendulum fashion. The cable sheaves 4 are rotatably mounted, for example, on a sheave set 5 arranged on a cable car support 2. A sheave set 5 generally comprises a plurality of cable sheaves 4 arranged one behind the other in the direction of movement of the hoisting cable 3. A cable sheave 4, or a group of cable sheaves 4, is also often arranged on rockers 6 rotatably mounted on the sheave set 5. A large number of vehicles 7, for example gondolas or chairs, are clamped to the hoisting cable 3 in a known manner, for example with cable clamps that can be released in the cable car stations, but also with fixed clamps. The vehicles 7 are moved in this way on the hoisting cable 3 between the cable car stations. A number of cable sheaves 4, over which the hoisting cable 3 is guided, can also be arranged in a cable car station.

Figure 2:
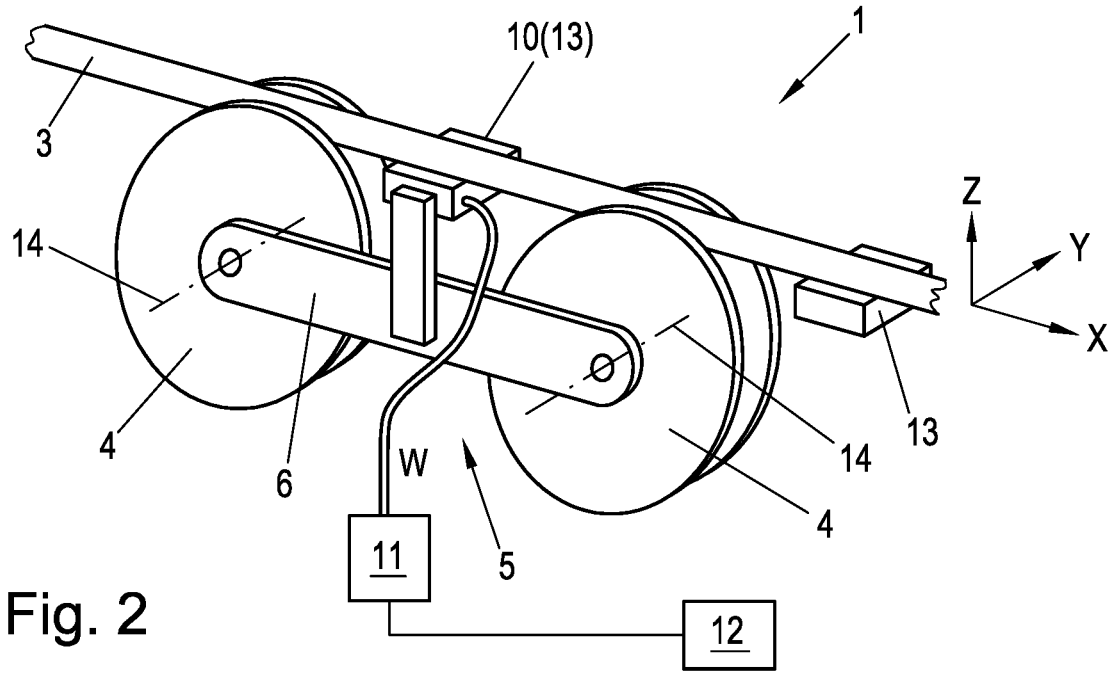
FIG. 2 shows part of a sheave set of a cable car system.

FIG. 2 shows part of a sheave set 5 with two cable sheaves 4. At least one contactless cable sensor 10 is arranged on the cable car system 1, for example on the sheave set 5. The contactless cable sensor 10 is preferably arranged in a known, defined position relative to a cable sheave 4, in particular at a defined distance A from the hoisting cable 3. If the contactless cable sensor 10 is arranged on a rocker 6, as in FIG. 2, the contactless cable sensor 10 is then preferably arranged on the rocker 6 in a defined position relative to the cable sheaves 4. If the cable sheaves 4 are rotatably mounted in a stationary manner on the sheave set 5 (i.e., not on rockers 6), then the contactless cable sensor 10 is preferably arranged in a defined position relative to the cable sheaves 4 of the sheave set 5. However, a plurality of contactless cable sensors 10 can also be provided on a sheave set 5, for example in the region of the outer ends of the sheave set 5 as viewed in the conveying direction X of the hoisting cable 3. It should be noted, however, that the cable sheave 4 and the contactless cable sensor 10 can also be (in the case of the cable sheave 4 rotatably) mounted on another stationary part of the cable car system 1, for example in a cable car station or in the region of the entrance to or exit from a cable car station or on another component of a cable car support 2. A plurality of cable sensors 10 are usually arranged in a distributed manner on a cable car system 1.

The contactless cable sensor 10 can be an inductively or capacitively operating sensor, for example an inductive or capacitive proximity sensor, a Hall sensor or an eddy current sensor. The contactless cable sensor 10 preferably simultaneously serves as a cable position sensor for detecting the lateral deflection in the transverse direction Y (transverse to the conveying direction X) of the hoisting cable 3 on the cable sheave 4. In this case, the contactless cable sensor 10 is preferably also aligned in a defined lateral position relative to the cable sheave 4. However, it is also conceivable that a separate cable position sensor 13 (or several cable position sensors 13) is provided, as indicated in FIG. 2.

The contactless cable sensor 10 is connected to an evaluation unit 11 (hardware and/or software) in order to evaluate the sensor values detected thereby, as will be described in detail below. It can be provided that each contactless cable sensor 10 is connected to its own evaluation unit 11, or that several contactless cable sensors 10, for example the cable sensors 10 of one (or both) conveying direction(s) X of a cable car support 2, are each connected to an evaluation unit 11. The at least one evaluation unit 11 is connected to the cable car control 12 (hardware and software), which can be done both wirelessly and wired. The cable car control 12 is usually arranged in a cable car station. An evaluation unit 11 can also be integrated into the cable car control 12. If a separate cable position sensor 13 is used, the evaluation unit 11 can at the same time also be connected to the cable position sensor 13 in order to detect the cable position of the hoisting cable 3 in the transverse direction Y. However, a separate evaluation unit can also be provided for the cable position sensor 13. An evaluation unit 11 can also be integrated in the cable sensor 10 or a cable position sensor 13.

Figure 3:
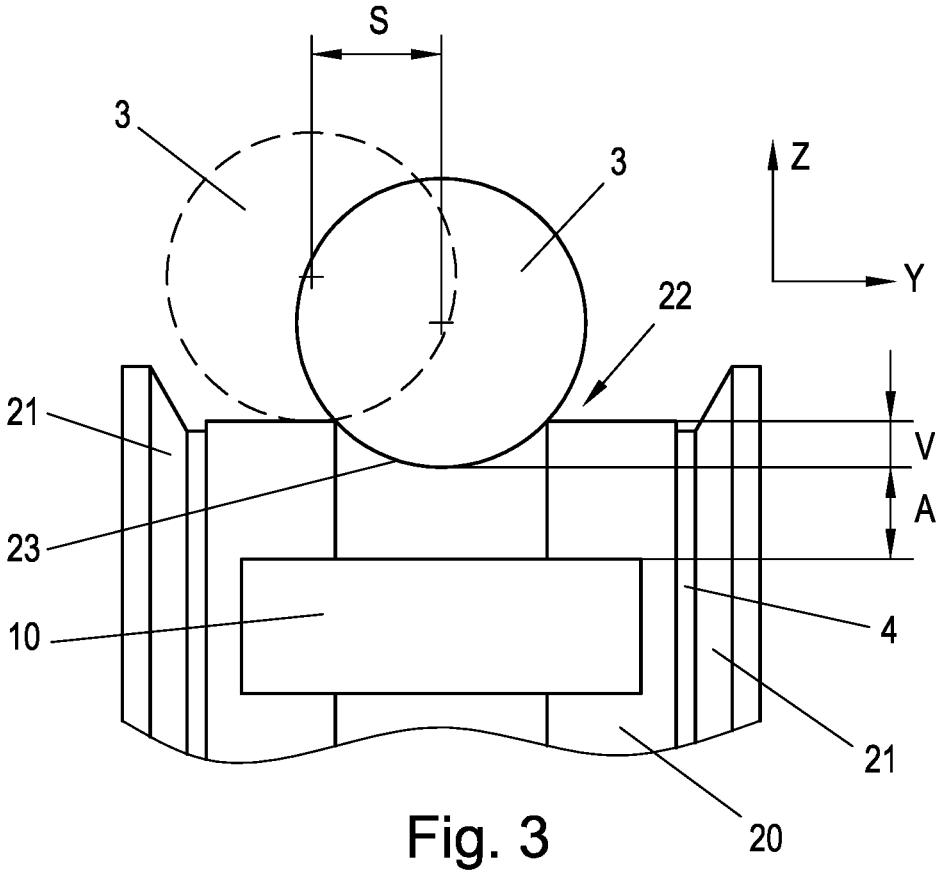
FIG. 3 shows part of a cable sheave of a cable car system.

FIG. 3 shows a cable sheave 4 in detail. The cable sheave 4 usually consists substantially of a central sheave body (not visible in FIG. 3) which is rotatably mounted on a central bearing bushing (not visible in FIG. 3) by means of roller bearings or other bearings. The cable sheave 4 can be arranged in the cable car system 1 via the bearing bushing. Of course, the bearing bushing could also be omitted, and the cable sheave could be rotatably mounted directly on the bearing on the cable car system 1. A rubber washer 20 can be arranged on the sheave body between two laterally arranged flange washers 21. The rubber washer 20 forms the running surface 22 of the cable sheave 4, in which a cable groove 23 in the form of a recess for guiding the hoisting cable 3 can be provided. The rubber washer 20 is usually arranged so as to be exchangeable. Of course, the sheave body itself could also form the running surface 22 and/or a flange washer 21 of the cable sheave 4. During operation of the cable car system 1, the hoisting cable 3 may be deflected laterally out of the cable groove 23 in the transverse direction Y, as indicated by dashed lines in FIG. 3. Such a deflection S in the transverse direction Y can be detected by a cable position sensor 13 when the cable car system 1 is in operation.

It can also be seen in FIG. 3 that the hoisting cable 3 eats further and further into the running surface 22 of the cable sheave 4 as the running surface 22 wears, with the result that the hoisting cable 3 migrates in the direction of the axis of rotation 14 of the cable sheave 4. For safety reasons, only a certain amount of wear on the cable sheave 4 is permitted. With increasing wear, the depression V of the cable groove 23 increases. In the event of excessive wear, the cable sheave 4 or the rubber washer 20, or generally the part of the cable sheave 4 that forms the running surface 22, must be replaced.

The contactless cable sensor 10 is arranged in a known position relative to the cable sheave 4, so that there is a distance A (in the direction Z normal to the conveying direction X and the transverse direction Y) between the hoisting cable 3 and the cable sensor 10. The cable sensor 10 is preferably arranged in a defined position relative to the unworn cable sheave 4 in order to have a defined reference position. However, the reference position can also be set differently. If the wear increases, as a result of which the depression V increases, the distance A decreases, as a result of which the wear of the running surface 22 of the cable sheave 4 can be identified in the form of the increase in the depression V when the distance A is measured with the contactless cable sensor 10.

Usually, the sensor value W detected by the cable sensor 10 is converted in the evaluation unit 11 to the distance A (or, equivalently, to the depression V). Typically, the distance A is the shortest distance between the cable sensor 10 and the hoisting cable, usually in the direction Z.

In order to reduce the influence of the operation of the cable car system 1 on the distance measurement, or preferably to eliminate it completely, according to the present teaching only a distance A measured when the cable car system 1 is at a standstill is used for wear detection. The distance A is thus measured with the hoisting cable 3 is at a standstill. When the hoisting cable 3 is at a standstill, it can be assumed that the hoisting cable 3 is located in the cable groove 23 of the cable sheave 4 and that the hoisting cable 3 does not vibrate or only vibrates very slightly.

In addition, by measuring the distance A when the cable car system 1 is at a standstill, the temperature influence on the measurement of the distance A can be reduced, ideally even eliminated. At a standstill, there can be no friction between the hoisting cable 3 and the cable sheave 4, so that the cable sheave 4 is not subject to any additional thermal expansion caused by the frictional heat, which makes the measurement of the distance A more accurate. The cable sheave 4 and the cable sensor 10 consequently have substantially the same temperature (substantially the ambient temperature), provided that the cable sensor 10 is not subject to excessive self-heating by the built-in electronics or different solar radiation occurs (e.g., due to shading), so there are no measurement errors due to temperature differences between the temperature of the cable sheave 4 and the temperature of the cable sensor 10.

The temperature prevailing for measuring the distance A could also be measured, for example by means of a temperature sensor in the cable sensor 10 or in the vicinity of the cable sheave 4, and the measured distance A could be corrected to a predetermined reference temperature (e.g., 21° C.). In this way, for example, any thermal expansion caused by solar radiation can be compensated for. For this purpose, the thermal expansion of the cable sheave 4 can be determined with the measured temperature, for example by means of stored tables, a mathematical model or a formula, and the temperature-related expansion of the cable sheave 4 (which changes the distance A) can be taken into account when determining the distance A.

The distance A is preferably always measured at the same point in time in a full day, for example before the cable car system 1 is put into operation in the morning, preferably before or not too long after sunrise, or after the cable car system 1 is shut down in the evening, preferably after sunset or not too long before sunset. If measurements are taken after the shutdown, there is preferably a wait for the measurement for a certain fixed time, for example one hour, so that the cable sheaves 4 can cool down to the ambient temperature. However, since solar radiation can also lead to thermal expansion of the cable sheaves 4, the measurement is carried out preferably at night (between sunset and sunrise). Any point in time between shutdown and putting into operation can also be specified for the measurement of the distance A, for example measurement always at midnight. Since the wear will only manifest itself slowly in an increase in the depression V and the measurement resolution of the cable sensor 10 is also limited, it may also be sufficient if the distance A or the associated depression V is measured not every full day but is measured in a greater time interval, for example every week or every xth full day where x>1.

The measurement of the distance A when the cable car system 1 is at a standstill also makes it possible, in a particularly advantageous manner, to use a conventional contactless cable position sensor 13 as the cable sensor 10, which is already installed in today's cable car systems 1. In particular, contactless cable position sensors 13 of particularly simple design can be used as cable sensors 10, which, due to the measurement principle, cannot be used per se to identify whether the hoisting cable 3 moves to the left, to the right (i.e., in the transverse direction) or, due to wear, in the Z direction relative to the axis of rotation 14 of the cable sheave 4.

An example of such a contactless cable position sensor 13 is an inductive proximity sensor. Inductive proximity sensors measure the distance to the measuring object contactlessly using induced voltage. For example, a sensor coil of the sensor that is fed with alternating current forms an electromagnetic field around the sensor coil. If an electrically conductive measurement object (here the hoisting cable 3) gets into this field, eddy currents are induced in the measurement object, the electromagnetic fields of which eddy currents counteract the electromagnetic field generated by the sensor coil, as a result of which the impedance of the sensor coil changes. This change is in a defined relationship to the distance of the measurement object and is evaluated accordingly, for example electronically or after digital conversion by appropriate software. Of course, other measurement principles can also be used.

Figure 4:
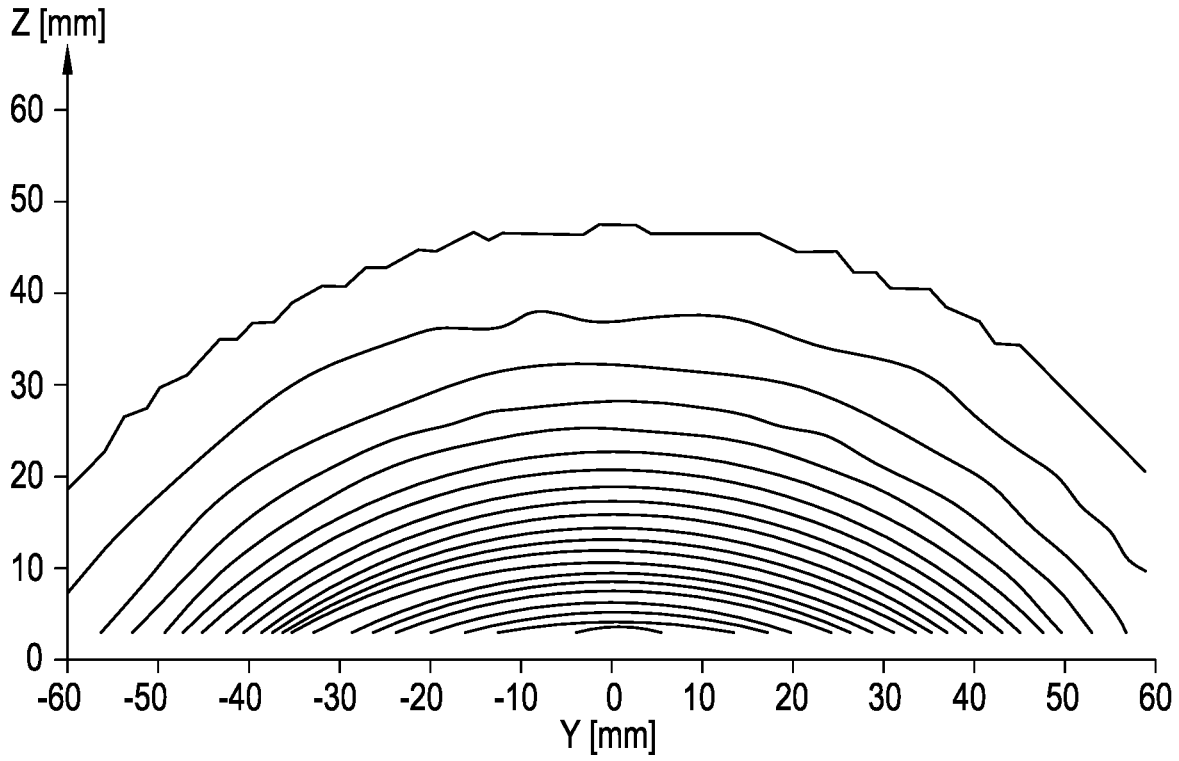
FIG. 4 shows a measuring field of a contactless cable sensor.

An exemplary measurement map of a contactless cable sensor 10, for example an inductive proximity sensor, is shown in FIG. 4, which shows lines of constant sensor values W regarding the position of the measurement object (in the transverse direction Y and the direction Z) relative to the cable sensor 10. The position of the measurement object is here based on a zero position Y=0 (for example the position of a cable groove 23) and is given to the left (Y negative) and to the right (Y positive) and as the distance in direction Z between the cable sensor 10 and the measurement object (the hoisting cable 3). From the measurement map it can be seen that each detected sensor value W can be interpreted as a deviation to the left, right or in the direction Z, which is why it is not possible to deduce the specific position of the measurement object in relation to the cable sensor 10 from the sensor value W. A distinction between the transverse direction Y and the direction Z is nevertheless possible with such a cable sensor 10 because a lateral deflection of the hoisting cable 3 in the transverse direction Y increases the distance between the hoisting cable 3 and the cable sensor 10, while wear reduces the distance between the hoisting cable and the cable sensor 10. Starting from a known reference position, a deflection in the transverse direction Y and wear in the direction Z can therefore be identified by an increase or decrease in the detected sensor value. For example, the sensor value decreases when the hoisting cable 3 is deflected in the transverse direction Y and increases in the event of wear in the Z direction (i.e., when the hoisting cable 3 approaches the cable sensor 10). A detected sensor value W of the cable sensor 10 can thus be clearly assigned to a lateral deviation of the hoisting cable 3 in the transverse direction Y or to a change in the distance A in the Z direction.

The same or similar relationships can also arise when other measurement principles are used. In principle, however, it is also possible to use sensors which, on the basis of the measurement principle or the evaluation of the sensor values W, can differentiate between lateral deviations and changes in distance. However, since such sensors are more complex and therefore more expensive, they are usually not used in cable car systems 1, in particular because a large number of cable sensors 10 are generally required in a cable car system 1 (typically at least two such cable sensors 10 on each cable car support in each direction of the hoisting cable 3, which leads to eighty sensors with twenty cable car supports).

For the cable sensor 10, when measuring at a standstill, it can be assumed that the hoisting cable 3 is located in the cable groove 23 of the cable sheave 4. In this way, the sensor value W measured at a standstill can in any case be assigned to the distance A between the cable sensor 10 and the hoisting cable 3, fully independently of the type of the cable sensor 10.

Since the cable sensor 10 is usually arranged at a distance from the cable sheave 4 in the conveying direction X, the detected sensor value W can, with the known arrangement and geometry of the cable sheave 4 and the cable sensor 10, be converted to the distance A (or equivalently to the depression V) or a related wear value in order to increase the accuracy.

Of course, with a cable sensor 10 only the wear of cable sheaves 4 can be reliably detected, which are arranged in sufficient proximity and in a known position relative to the cable sensor 10. The further away a cable sheave 4 is arranged from the cable sensor 10, the more inaccurate the detection of the wear will be. Due to the known arrangement and geometry of the cable sheaves 4 in a region of the cable car system 1, for example on a sheave set 5 or a rocker 6, however, a conversion can be made from the sensor values W of a cable sensor 10 in the region of the arrangement of cable sheaves 4 to the wear of several cable sheaves 4 of the arrangement.

In order to increase the accuracy, sensor values W of various cable sensors 10 could also be evaluated in order to determine the wear (for example the value of the depression V) of a cable sheave 4. For example, the wear of a cable sheave 4 could be determined with sensor values W of different cable sensors 10, which are then averaged. In this case, weightings could also be taken into account in the averaging, which assess the distance of the cable sensor 10 from the cable sheave 4.

Figure 5:
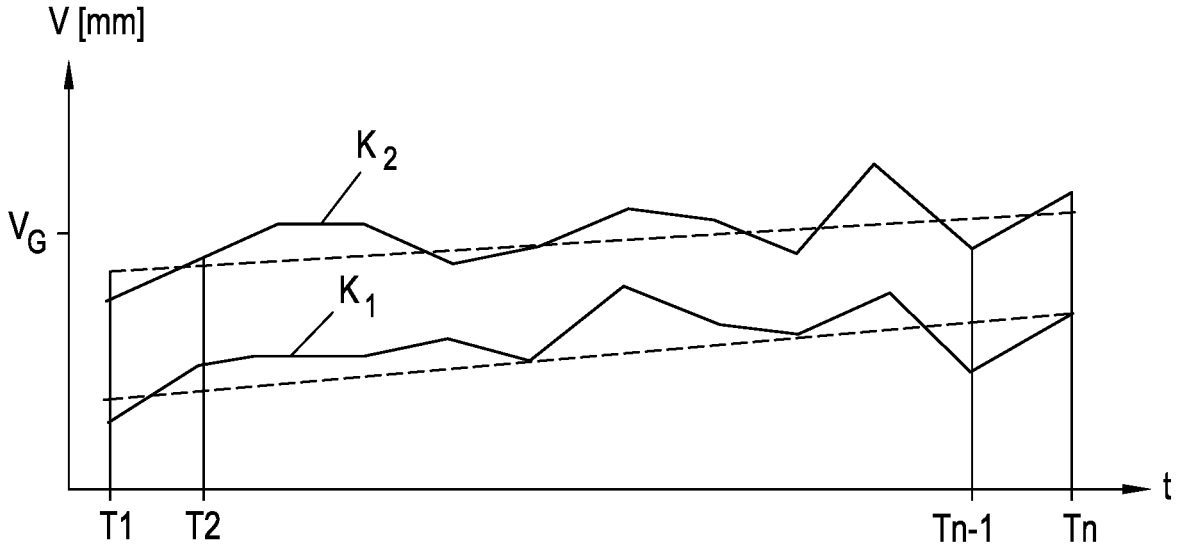
FIG. 5 shows the progression over time of the detected wear on cable sheaves.

In FIG. 5, the time course $K_1$, $K_2$ of the increase in the depression V over a period of time T1 to Tn, which, for example, covers a period of 3 months, is shown for two cable sheaves 4. Starting from a depression V at the beginning at time T1, the depression V increases continuously until the end of the period of time at Tn.

It can be seen that a detected depression V can be subject to fluctuations despite the measurement when the cable car system 1 is at a standstill, which can be attributed to external influences or to measurement inaccuracies. In order to compensate for these fluctuations, the wear trend can also be approximated by a regression line (indicated by dashed lines in FIG. 5), or another regression, in order to be able to determine a wear value at any point in time, in particular also between the measurements.

A limit value $V_G$ for the permissible wear, for example in the form of a maximum permissible depression V, can be specified (in percent or as an absolute value). If the wear of a cable sheave 4 reaches the limit value $V_G$, a message can be output by the evaluation unit 11 or the cable car control 12 in order to indicate a necessary change of the cable sheave 4 or the rubber sheave 20 of the cable sheave 4. The message can also be sent via a suitable communication line to a remote location, for example to a maintenance center, from which maintenance is coordinated.

The invention claimed is:

1. A method for detecting wear on at least one cable sheave of a cable car system having a hoisting cable, which is guided over the at least one cable sheave, comprising the steps of:

providing at least one cable sensor which is arranged in a known position with respect to the cable sheave, the cable sheave being unworn, at a defined distance from the hoisting cable in order to have a defined reference position;

detecting with the cable sensor an actual distance between the hoisting cable and the cable sensor when the hoisting cable is at a standstill; and determining the wear on the at least one cable sheave from the actual distance between the hoisting cable and the cable sensor, wherein the step of determining the wear uses the actual distance detected only at the standstill of the hoisting cable.

2. The method according to claim 1, wherein a temperature of the cable sheave is detected and a thermal expansion of the cable sheave at the detected temperature is taken into account when the distance is detected.

3. The method according to claim 1, wherein the at least one cable sensor is used to detect the wear on at least one further cable sheave.

4. The method according to claim 1, wherein the wear on the at least one cable sheave is detected by at least one further cable sensor and the wear detected by the various cable sensors is averaged for the wear on the at least one cable sheave.

5. The method according to claim 1, wherein the distance is measured at a predetermined time interval.

6. The method according to claim 5, wherein the distance is always measured at the same point in time in a full day.

7. The method according to claim 5, wherein the progression of the wear over time is detected.

8. The method according to claim 1, wherein the cable sheave of the cable car system is replaced when the wear exceeds a predetermined permissible limit value.

9. The method according to claim 5, wherein the distance is measured every xth day where x>1.

* * * * *